US005409221A

United States Patent [19]

Cohn

[11] Patent Number: 5,409,221

[45] Date of Patent: Apr. 25, 1995

[54] BASEBALL GAME

[76] Inventor: Joseph Cohn, 1482 E. Valley Road #A141, Santa Barbara, Calif. 93108

[21] Appl. No.: 99,379

[22] Filed: Jul. 30, 1993

[51] Int. Cl.[6] ..... A63F 7/06

[52] U.S. Cl. ..... 273/89; 273/90

[58] Field of Search ..... 273/85 R, 85 A, 85 B, 273/85 E, 85 F, 88, 89, 90, 119 R, 129 R, 129 S, 129 T, 129 V, 129 W, 93 R

[56] References Cited

U.S. PATENT DOCUMENTS

| | | | |
|---|---|---|---|
| 811,963 | 2/1906 | Shaules | 273/88 |
| 968,249 | 8/1910 | Meeker | 273/89 |
| 983,250 | 1/1911 | Porter | 273/89 |
| 1,122,141 | 12/1914 | McIlroy | 273/89 |
| 1,147,087 | 7/1915 | Groh | 273/89 |
| 1,220,980 | 3/1917 | Griesel | 273/88 |
| 1,507,256 | 9/1924 | Severe | 273/89 |
| 1,539,610 | 5/1925 | Tracy | 273/89 |
| 1,588,440 | 6/1926 | Boosey | 273/88 |
| 1,623,038 | 4/1927 | Babbitt | 273/89 |
| 1,682,170 | 8/1928 | Ekelund | 273/89 |
| 1,685,428 | 9/1928 | Lowry | 273/89 |
| 1,793,969 | 2/1931 | Simmons | 273/89 |
| 1,795,801 | 3/1931 | Sechler | 273/89 |
| 1,942,429 | 1/1934 | Jacobs | 273/89 |
| 1,955,104 | 4/1934 | Spier | 273/88 |
| 2,534,468 | 12/1950 | Mitchell | 273/89 |
| 2,775,457 | 12/1956 | Galbos | 273/89 |
| 4,976,434 | 12/1990 | Wikner | 273/89 X |

*Primary Examiner*—Sebastiano Passaniti

*Attorney, Agent, or Firm*—Dickinson, Wright, Moon Van Dusen & Freeman

[57] ABSTRACT

A mechanical baseball game comprising a playing board with a representation of a baseball field thereon, a movable bat which is capable of hitting from both sides of home plate, a ball, a pitching mechanism, a batting mechanism, and a plurality of batters, pitchers, and outfielders, all of which are modeled after particular real life players and are capable of simulating certain playing characteristics of these players.

15 Claims, 7 Drawing Sheets

FIG. 2
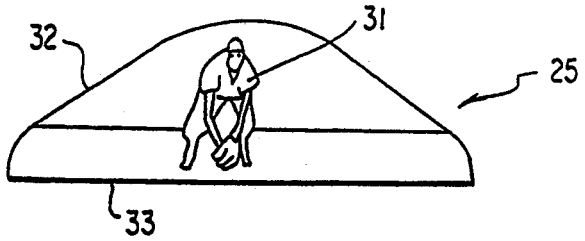
FIG. 3a
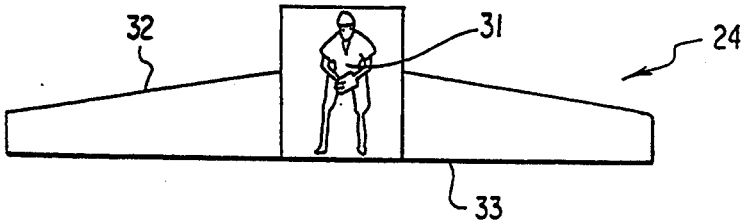
FIG. 3b
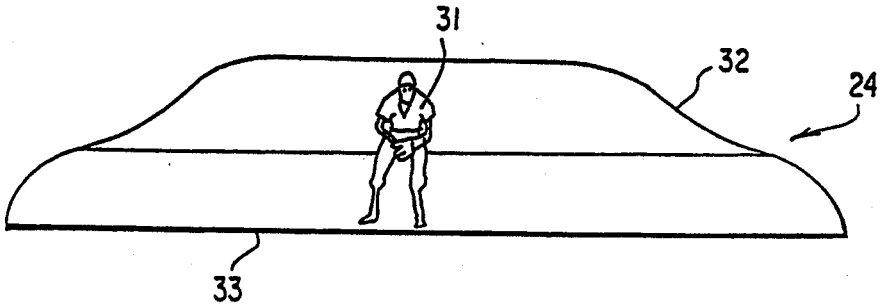
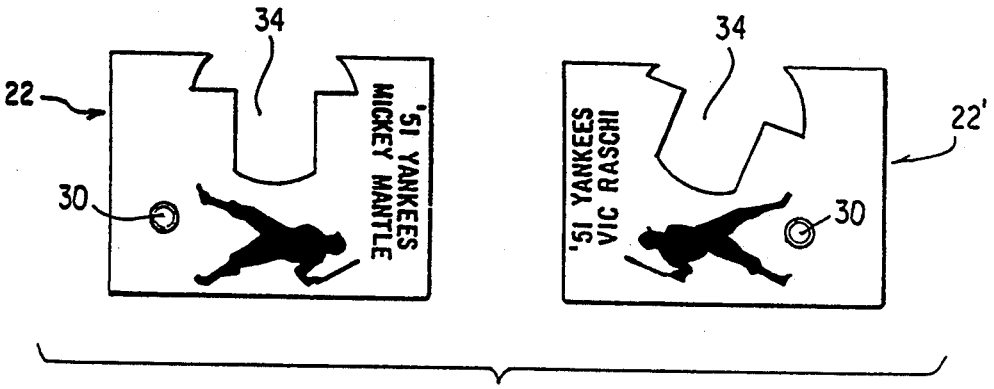
FIG. 4

BASEBALL GAME

FIELD OF THE INVENTION

This invention relates generally to games and more specifically to a mechanical baseball game which is played on a playing board with playing pieces and which simulates a real baseball game.

BACKGROUND OF THE INVENTION

Numerous baseball board games have been proposed in the prior art. In this regard, U.S. Pat. Nos. 1,400,020, 1,533,487, 1,539,610, 1,682,170, 3,972,530, 4,017,074, and 4,653,755 are all illustrative. None of these prior art games are suitable to accomplish the objects of the present invention as hereinafter described.

SUMMARY OF THE INVENTION

A principal object of the present invention is to provide a mechanical baseball game played on a playing board with a plurality of playing pieces, including batters, pitchers, and fielders, in which each playing piece exhibits certain playing characteristics of real life players.

A further object of the present invention is to provide a mechanical baseball game in which each playing piece is modeled after and exhibits certain playing characteristics of a particular real life major league baseball player.

Another object of the present invention is to provide a mechanical baseball game in which each of the batters is designed to exhibit certain batting characteristics of real life baseball players.

A further object of the present invention is to provide a mechanical baseball game in which each batter is modeled after and exhibits certain batting characteristics of a particular real life major league baseball player.

Another object of the present invention is to provide a mechanical baseball game in which the batters may bat in either a left-handed or a right-handed manner.

A further object of the present invention is to provide a mechanical baseball game in which each of the fielders is designed to exhibit certain fielding characteristics of real life baseball players.

Another object of the present invention is to provide a mechanical baseball game in which each of the fielders is modeled after and exhibits certain fielding characteristics of a particular real life major league baseball player.

A further object of the present invention is to provide a batting mechanism, not permanently attached to the game board, which is capable of hitting from both sides of the plate so as to simulate both right-handed and left-handed batters.

A further object of the present invention is to provide a method of adjusting the direction of the bat to represent pull, straight-away, and punch hitting.

Still a further object of the present invention is to provide a method of keying the bat to the batting characteristics of an individual batter.

A further object of the present invention is to provide a method of controlling the speed and direction of the pitch.

A further object of the present invention is to provide a method of getting lift on the ball by using a ball possessing the proper combination of size, weight, and speed, and by using a bat of the proper diameter and bat speed.

The above and related objects may be accomplished by the present invention, as hereinafter disclosed. It is to be understood that the drawings provided are merely illustrative and that changes may be made to the specific constructions illustrated and described therein without departing from the scope of the invention.

BRIEF DESCRIPTION OF THE DRAWINGS

FIG. 2, 3*a* and 3*b* are front views of preferred embodiments of defensive playing pieces;

FIG. 4 is a top view of a preferred embodiment of two playing pieces designated as batters;

PREFERRED EMBODIMENTS OF THE INVENTION

Figure 1:
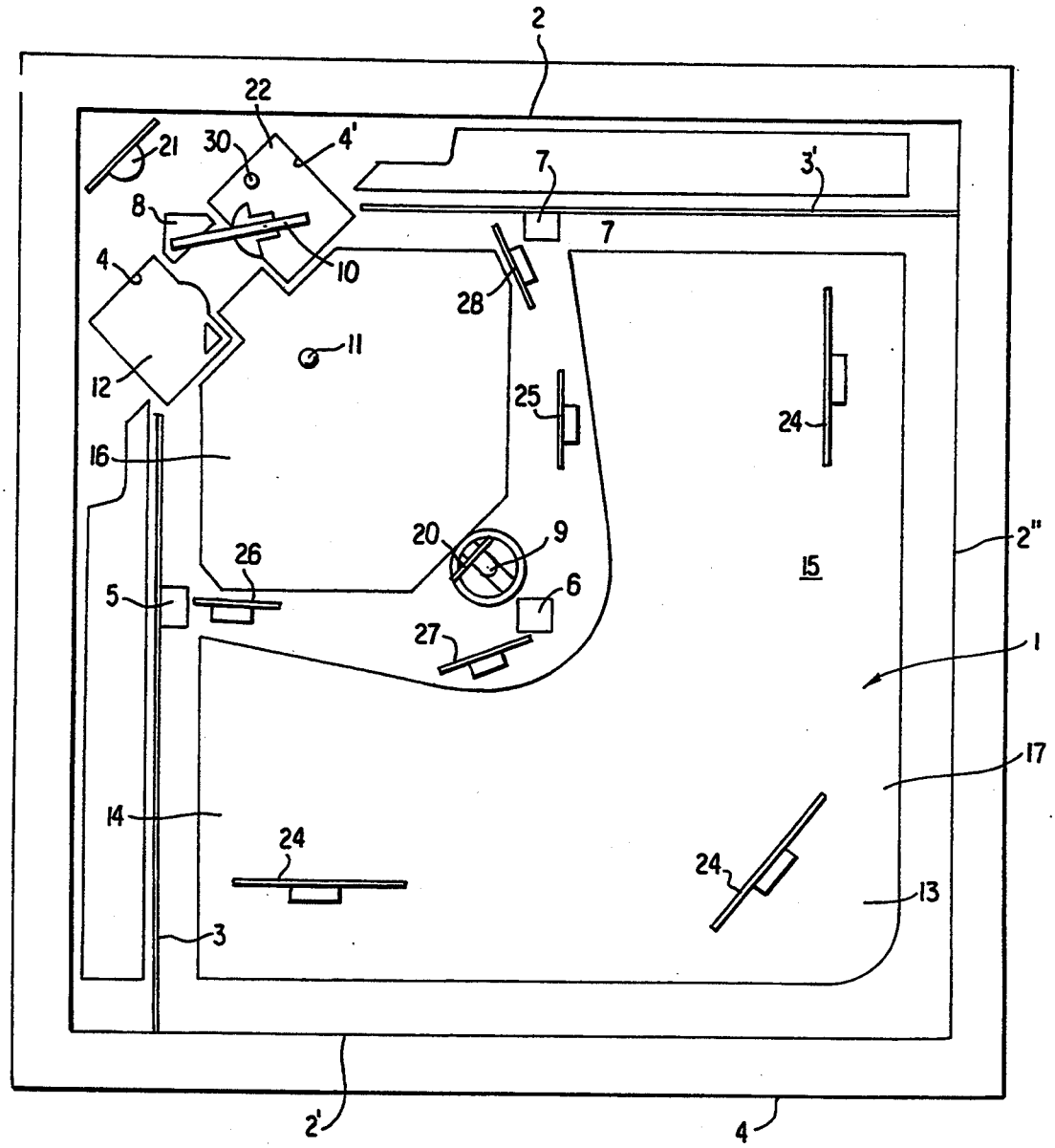
FIG. 1 shows a top plan view of a preferred embodiment of the game of the present invention.

As illustrated in FIG. 1, the game board 1 of the present invention is designed to simulate a regulation baseball field and includes a first base 5, a second base 6, a third base 7, and a home plate 8. The board further includes a wall 2, foul lines 3, 3' center field 13, right field 14, left field 15, an infield 16, and an outfield 17. The wall 2 is divided into segments, including a right field wall 2' and a left field wall 2''. While the present invention contemplates the use of a game board of any appropriate dimensions or shape, it is preferred that the game board is square with each side 24" in length.

The game is further provided with the usual complement of playing pieces, including a pitcher 20, a catcher 21, batters 22, outfielders 24, a shortstop 25, a first baseman 26, a second baseman 27, and a third baseman 28. The individual playing pieces used in the present invention are designed to exhibit the playing characteristics of real life players, preferably particular real life major league players. For the sake of convenience, the term "fielders" will be used to refer to the group consisting of outfielders, shortstops, first basemen, second basemen, and third basemen. The term "defensive pieces" will be used to refer to the group consisting of fielders, pitchers, and catchers. While the present invention contemplates the use of playing pieces which are fixed to the game board, it is preferred that at least the fielders are free standing and capable of being placed anywhere on the surface of the game board.

The game is played simultaneously by two players. The game is provided with a pitching mechanism 9 which delivers the ball 11 towards home plate 8. The game is further provided with a movable bat 10, which is capable of hitting the ball into the playing field. There are slots 4,4' on each side of home plate, capable of accommodating either a right-handed or left-handed batter. A cover 12 is provided to close either slot when it is not in use. The players take turns batting and playing the field. The player who is "in the field" controls the pitching mechanism 9 and the placement of the fielders, and the player who is "up at bat" controls the batting mechanism 10.

The rules of the game are essentially those of major league baseball, though the rules of play can be changed according to user preference without departing from the scope of the invention. The preferred rules are outlined as follows.

To achieve a strike, the player controlling the pitching mechanism 9 must cause the ball 11 to pass over home plate without being hit and to directly impinge upon the catcher 21. If the batter fails to swing at a pitch and the ball fails to impinge directly upon the catcher, the pitch is counted as a ball.

The player whose team is "up at bat" uses the batting mechanism 10 to hit the ball 11 into the outfield 17 or over the wall 2. A ball is "caught" by a defensive playing piece when the ball impinges on that piece without first coming into contact with the surface of the game board. However, any ball hit through the infield 16 which impinges on an outfielder after coming into contact with the surface of the game board but which does not impinge on an infielder is ruled a single. Balls that reach the wall in right field 14 and left field 15 without impinging on any defensive pieces are ruled doubles, and balls that reach the wall in center field 13 without impinging on any defensive pieces are ruled triples. As in a real baseball game, a player scores a home run by hitting the ball over the wall 2 without causing the ball to cross the foul lines 3, 3' or to impinge on any defensive playing pieces. A batter may be represented on base (that is, as a baserunner) by any suitable means of representation which enables the players to keep track of the identity of the playing pieces on base (i.e., with a button).

Since most of the playing pieces of the present invention are free standing, the player "in the field" can position his defensive pieces where he anticipates that they will most likely be in the path of a batted ball. The player "in the field" might anticipate this position from the known characteristics of the batter and the manner in which he intends to pitch the ball.

In the preferred embodiment, the game is provided with chance determining means (i.e., dice, spinnable dials, etc.) which may be used alone or in conjunction with statistical tables to determine the outcome of such events as steals, going from first to third on a base hit, bunting, etc. The outcome of these events is preferably made to depend in part on the playing characteristics of the playing pieces involved in the event. Thus, for two pitchers who have identical characteristics other than the fact that one is right-handed and the other is left-handed, higher rolls of the dice might be required to successfully steal second base against the left-handed pitcher than to steal second base against the right-handed pitcher (i.e., a roll of 8–12 might be required to successfully steal second base against the left-handed pitcher, while a roll of 2–7 would be ruled an out; similarly, a roll of 6–12 might be required to steal second base against the right-handed pitcher, while a roll of 2–5 would be ruled an out).

The game of the present invention is designed to be played at various levels of complexity, depending on the desire of the players to indulge in the nuances of the game of baseball. The levels of complexity are determined by the extent to which the chance determining means are utilized in the play of the game. In its least complex form, for example, the game may be played without any use of the chance determining means. In its more complex forms, however, the game utilizes chance determining means, possibly in conjunction with statistical tables, to determine the outcome of several events (i.e., sacrifice bunts, stealing bases, etc.).

FIG. 2 shows a shortstop 25, which is typical in most respects of the fielders of the present invention. The playing piece is preferably about 1" in height and has a flat base 33 which allows it to be freestanding. In its preferred embodiment, the piece also contains a representation 31 of a player (here, a shortstop) which is placed in the middle of the piece. The representation may be a picture, drawing, or any other demarcation, preferably one which conveys to the user the position that the piece is to occupy or the player that the piece is modeled after.

In major league baseball, the probability that a defensive player will execute a play flawlessly if the ball is hit into his territory presumably depends on a number of factors, including the player's range (the distance from his initial position at which the player is capable of executing the play flawlessly), his ability to anticipate a pitch and the hitter's response to it, his ability to hold onto the ball if he reaches it, and the speed and accuracy with which he throws the ball once he catches it. The frequency with which a player executes a play flawlessly diminishes, probably along a normal curve, near the limits of the player's range. The fielders of the present invention are designed to simulate this relationship. Thus, the outer edge 32 of these playing pieces preferably have a shape similar to a bell curve. The frequency with which balls will impinge on these pieces increases inversely to the shortest distance between the trajectory of the ball and the playing piece. The width of the fielders as measured along the bottom 33 varies from piece to piece, depending upon the fielding characteristics of the piece and on the position that the piece plays. Thus, an outfielder has a wider base (preferably 5"–7"), on average, than an infielder (preferably 1.75"–2.25"). Similarly, a playing piece modeled after a player with good fielding ability has a wider base than a piece modeled after a player of the same position who has poor fielding ability.

As previously mentioned, the individual playing pieces used in the present invention are designed to exhibit certain playing characteristics of real life baseball players. In the preferred embodiment, each playing piece is modeled after and exhibits certain batting characteristics of a particular real life major league baseball player. In one such embodiment, for example, the playing pieces of one team are modeled after the members of the 1950 Brooklyn Dodgers, and the playing pieces of the other team are modeled after the 1950 Philadelphia Phillies. Any suitable means may be used to indicate the identity of the players. However, it is preferred that the names of the players are laminated or screened on a visible surface of the playing pieces. While it is preferred, for the sake of realism, that each defensive playing piece of the present invention is individually tailored to exhibit certain playing characteristics of real life players, and while it is further preferred that each playing piece of the present invention exhibits certain playing characteristics of particular real life major league players, the present invention also contemplates an embodiment containing a more limited variety of defensive playing pieces. In this embodiment, certain ranges are provided for each playing characteristic. Thus, if two real life major league players had a characteristic (i.e., footspeed) that fell into the same range (i.e., "fast", "average", or "slow"), the players would be classified identically as far as that characteristic was concerned, even if in actuality the players differed somewhat in regard to that characteristic. In this embodiment, the defensive playing pieces modeled after these players would be identical with regard to this characteristic (i.e., both would be labeled as having "fast" footspeed).

In the preferred embodiment, the player's name, team, and statistics may be printed on the playing piece. If ranges are used for the various playing characteristics, the player's rank for each characteristic (the range into which each of the player's characteristics falls) are indicated on the card. For example, the player's rankings in terms of fielding ability ( A: exceptional; B: good; C: slow or poor), throwing ability (a: exceptional; b: moderate; c: poor), and foot speed (1: fast; 2: moderate; 3: slow) may be indicated on the card. These rankings may be used in conjunction with chance determining means (i.e., dice or spinnable dials) and statistical tables to determine the outcome of such strategies as steals, going from first to third on a base hit to right field, bunting, etc. Hence, a typical ranking printed on the batting card might be Ab3, indicating a ballplayer of exceptional fielding ability, moderate throwing ability, and slow foot speed.

In one embodiment of the invention, the batters are designated as having overall fielding abilities of "A" (excellent), "B" (average), or "C" (poor). If the batter is modeled after a real life major league baseball player who plays more than one position in the field, the fielding ability for each position is indicated on the card. A defensive piece, also designated as "A", "B", or "C", may be paired up with each batter (i.e., a batter designated as having fielding ability "A" is paired up with a fielding piece designated as "A", etc.), depending on the position the batter is to play. The defensive pieces corresponding to each particular batter are substituted for the "batters" when their teams take the field. For a given position, the defensive pieces designated as "A" have the widest bases, and those designated as "C" have the narrowest bases. The fielding pieces designated as "B" have a width intermediate between the pieces designated as "A" and those designated as "C".

FIGS. 3*a* and 3*b* are similar to FIG. 2 but have greater widths as measured along the base 33, thus indicating that the pieces depicted in FIGS. 3*a* and 3*b* have greater overall fielding ability than the piece in FIG. 2.

FIG. 4 is a top view of the batters of the present invention. The invention contemplates the use of both left-handed batters 22 and right-handed batters 22'. In the preferred embodiment, the batters comprise a flat card 36 containing a cut-out 34, 34'. While the card may be of any suitable shape, it is preferably rectangular and is about 2" long, 1.5" wide, and 0.1" thick. The batters may be made out of any suitable material, such as wood or plastic, but are preferably made out of die-cut cardboard or chipboard. The batters may also be color coded to indicate their respective ball teams. In the preferred embodiment, each batter is equipped with a peg 30 which preferably rises about ¼" above the surface of the batter and which controls the magnitude of the angle of the backswing through which the bat is permitted to move. The peg may be inserted into a hole in the card, or may be molded directly into the card at the time of production. The placement of the peg determines the maximum power with which the bat can be swung. When the batter is modeled after a particular real life player, the placement of the peg is such as to impart to the batter a hitting power commensurate with the hitting power of that real life player.

The batters are equipped with a cut-out 34 or 34' which locks onto the batting mechanism and holds it securely in place. The batters preferably fit into one of two appropriately designed slots 4,4' in the playing field that are placed on each side of home plate.

Figure 5B:
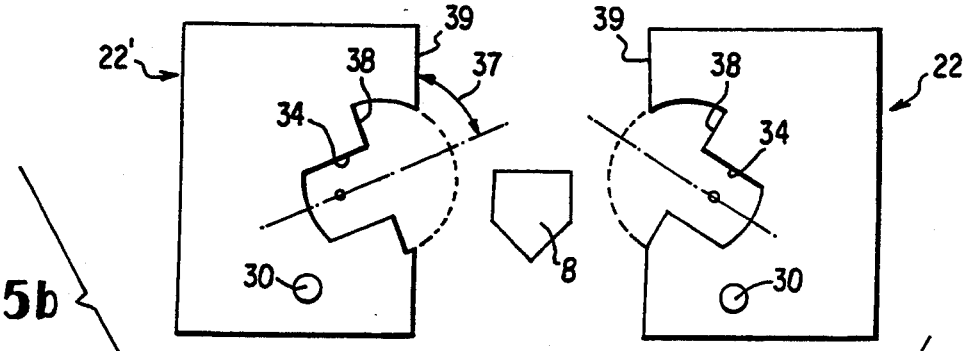
FIG. 5*a*, 5*b*, and 5*c* are top views of preferred embodiments of six playing pieces designated as batters.
Figure 5A:
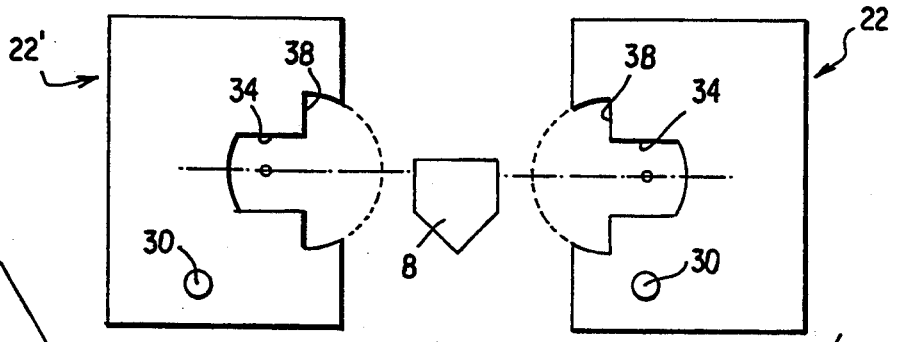
Figure 5C:
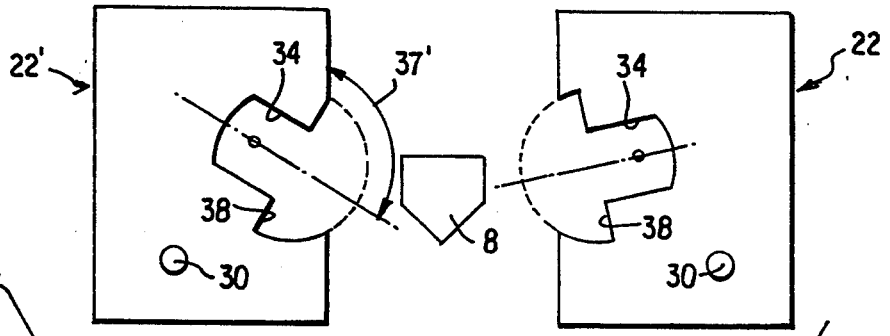

FIGS. 5*a–c* illustrate the preferred method of adjusting the direction of the bat to represent pull, straight-away, and punch hitting in both right-handed and left-handed batters. The cut-out 34 in the batter may be placed, as in FIG. 5*b* and FIG. 5*c*, in such a way that the angle 37 between the bat at rest (when the spring 64 in the batting mechanism is not distorted; see FIGS. 12–16) and the face 39 of the batter is greater or less than 90 degrees. When the angle is less than 90 degrees, as in FIG. 5*b*, the batter will tend to pull hit. When the angle is greater than 90 degrees, as in FIG. 5*c*, the batter will tend to punch hit. When the angle is close to 90 degrees, as in FIG. 5*a*, the batter will tend to hit straight-away. While the above-described method is the preferred method of representing pull, straight-away, and punch hitting, other suitable methods may be used to reflect these batting characteristics (i.e., adjusting the orientation of the slot 4 relative to the path of the ball).

While it is preferred, for the sake of realism, that each of the batters of the present invention is individually tailored to reflect the batting characteristics of a real life player, preferably a real life major league player, the present invention also contemplates an embodiment containing a more limited variety of playing pieces which simply reflect certain ranges of batting characteristics (i.e., hitting power which is strong, moderate, or weak, and hitting direction which is punch, pull, or straightaway), without regard to any "real life" player. This embodiment has the advantage of being more economical to manufacture.

Figure 6:
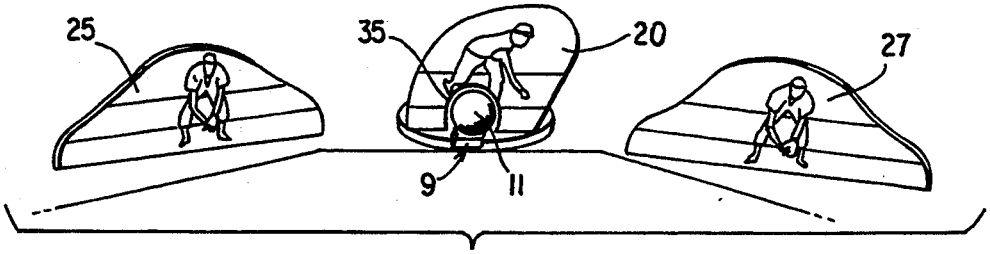
FIG. 6 is an elevated front view of a preferred embodiment of a portion of the playing field centered around the pitching mound.

FIG. 6 illustrates a preferred embodiment of the playing field centered around the pitching mechanism 9. The pitcher 20 is placed on top of the pitching mechanism, and contains a hole 35 of sufficient size so that the pitcher does not interfere with the ball 11 when it is pitched. FIG. 6 shows a shortstop 25 and a second baseman 27 placed to the left and right (facing the pitcher) of the pitcher, respectively, though these pieces are preferably movable and may be placed according to the discretion of the player who is controlling them.

Figure 9:
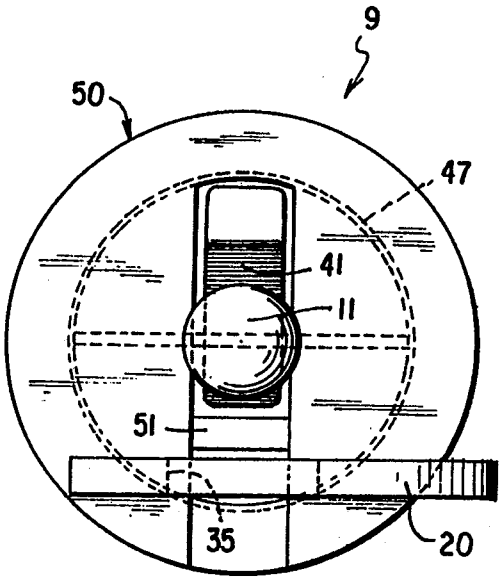
FIG. 9 is an enlarged top view in section of the preferred embodiment of the pitching mechanism.
Figure 8:
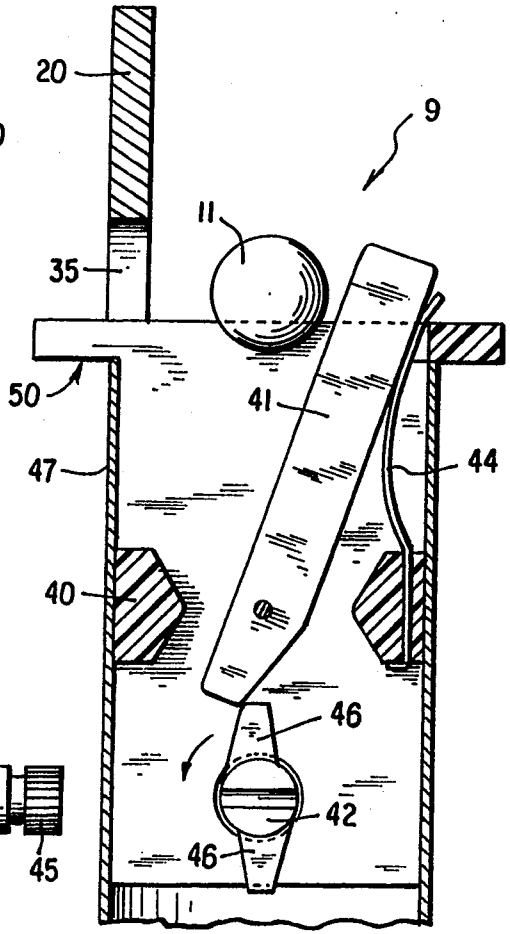
FIG. 8 is an enlarged side view in section of the pitching mechanism.
Figure 7:
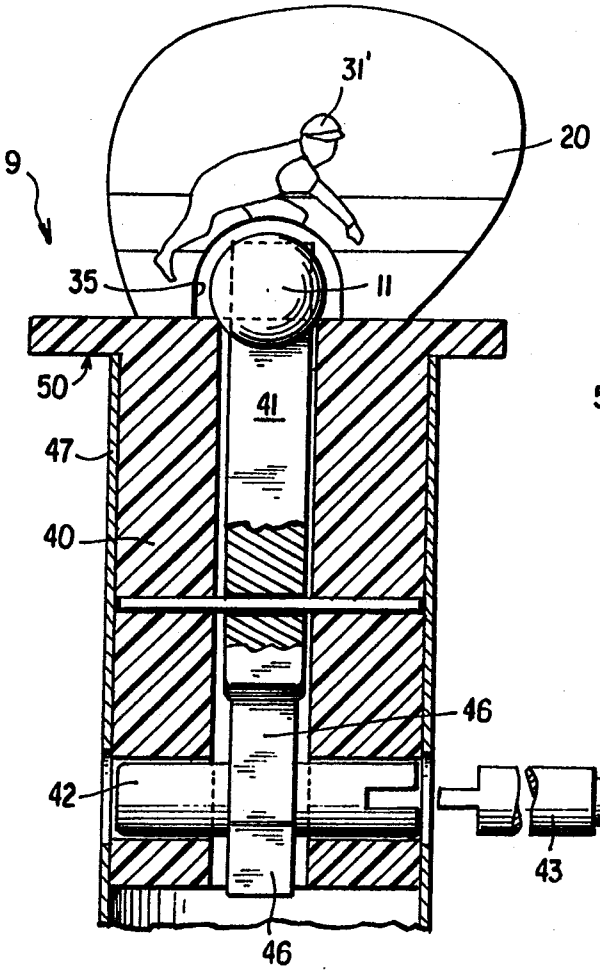
FIG. 7 is an enlarged front view in section of the preferred embodiment of the pitching mechanism.

FIGS. 7–9 illustrate the preferred embodiment of the means for pitching the ball. The pitching mechanism 9 of the present invention may be placed in the location corresponding to the placement of the pitching mound on a regulation-size baseball field. However, in the preferred embodiment it is placed further back in a position closer to second base.

The pitching mechanism comprises a spring-loaded lever or pitching arm 41 which is controlled by a control rod 43. The control rod is attached at one end to the cam 42 and terminates at the other end in a knob 45. The control rod extends underneath the game board in such a way that the end with the knob protrudes from a slot in the right field wall 2' (see FIG. 10). The player whose team is in the field manipulates the pitching mechanism, in part, by twisting the knob of the control rod in a counterclockwise direction.

FIG. 8 best illustrates the operation of the mechanism. When the control rod is twisted far enough in the counterclockwise direction, the cam arms 46 successively engage the pitching arm 41, force the pitching arm back against the spring 44 (thereby causing the spring to distort), and release the pitching arm. When the pitching arm is released, the spring pushes the pitching arm against the ball 11 and causes the ball to be pitched through the hole 35 in the pitcher 20. The speed of the ball is controlled by the placement of the ball on the pitching track 51. Thus, the closer the ball is placed to the pitching arm, the more the ball accelerates along the pitching track when the pitching arm is released.

The housing 40 of the pitching mechanism is cylindrical and fits loosely into a cylindrical well 47 in the game board so as to allow free rotation of the pitching mechanism. By moving the control rod to the left or right, the user can control the direction in which the ball is pitched. In its preferred embodiment, the housing of the pitching mechanism is equipped with a flange 50 whose thickness is about ⅛". The flange supports the pitching mechanism on the game board. The flange has the appearance of a pitcher's mound and adds to the realism of the game.

Figure 10:
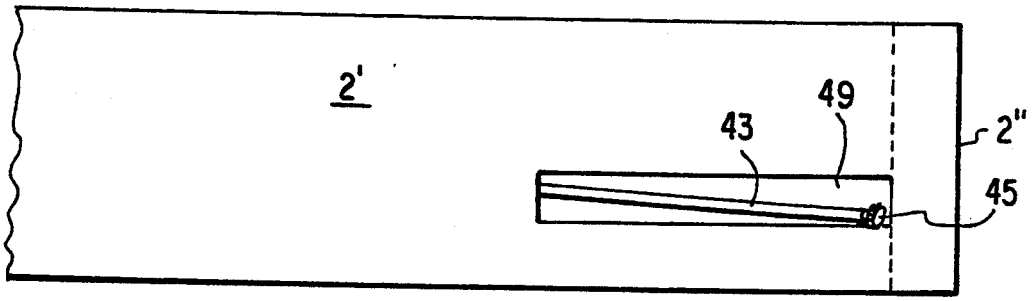
FIG. 10 is a side view of the control rod with which a user controls the pitching mechanism.
Figure 10A:
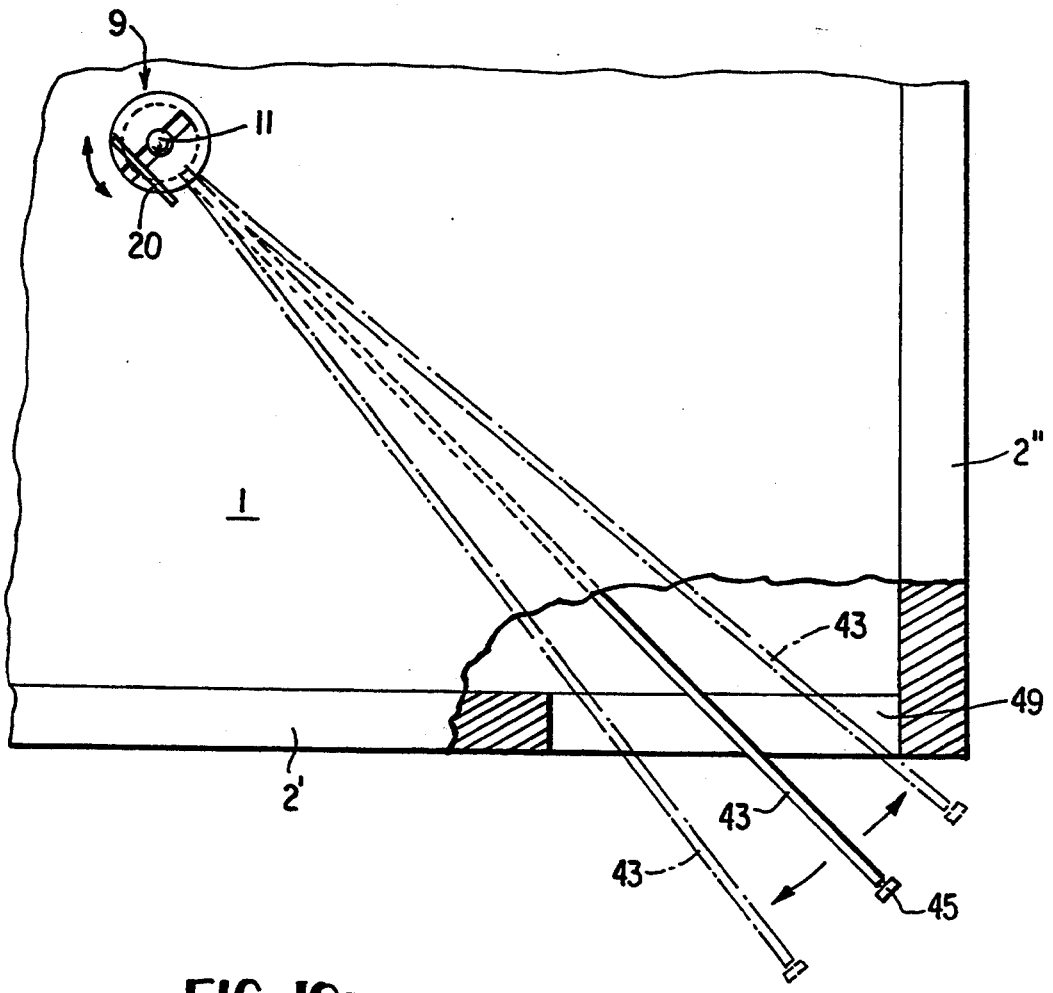
FIG. 10*a* is a top view partially in section illustrating the movement of the control rod with respect to the pitching mechanism.
Figure 15:
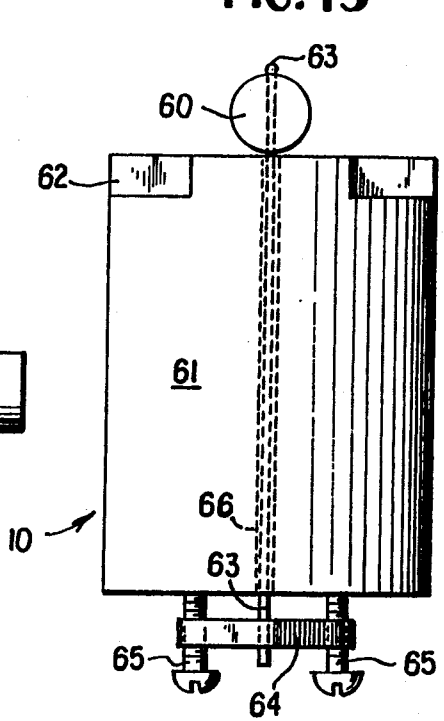
FIG. 15 is an enlarged rear view of the batting mechanism.

FIGS. 10 and 10*a* illustrate the placement of the controls for the pitching mechanism. The pitching mechanism is manipulated through a control rod 43. The control rod protrudes through an aperture 49 in the right field wall 2'. The aperture is sufficiently large to allow a player to manipulate the control rod freely.

Figure 11:
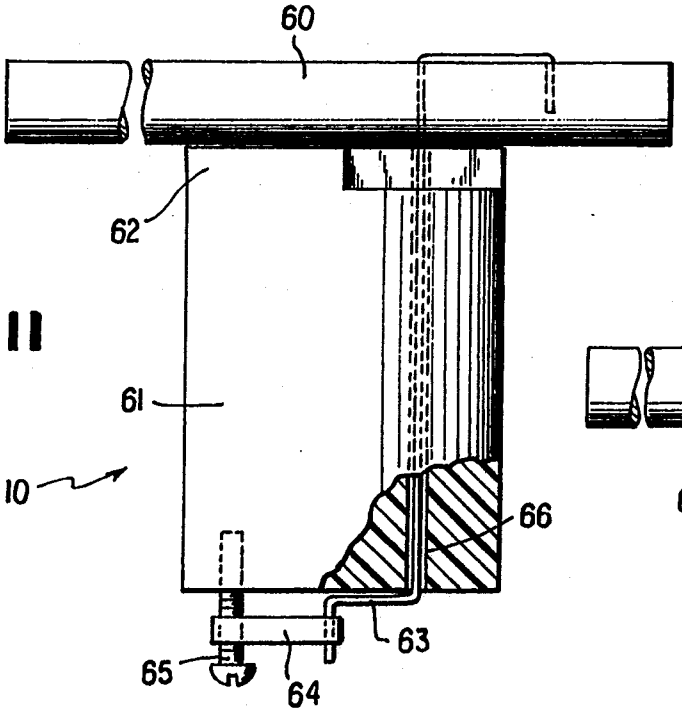
FIG. 11 is an enlarged side view partially in section of the batting mechanism.

FIGS. 11–5 show the preferred embodiment of the batting mechanism 10 of the present invention. The batting mechanism housing 61 is cylindrical in shape and is constructed so that the batting mechanism fits into either of two cylindrical wells 68, 68' placed on opposite sides of home plate (see FIG. 1). The batting mechanism is supported on the game board by the bat 60. While the bat is preferably flush against the surface of the game board, the invention contemplates the use of a bat horizontally disposed at a distance above the surface of the game board.

Figure 16:
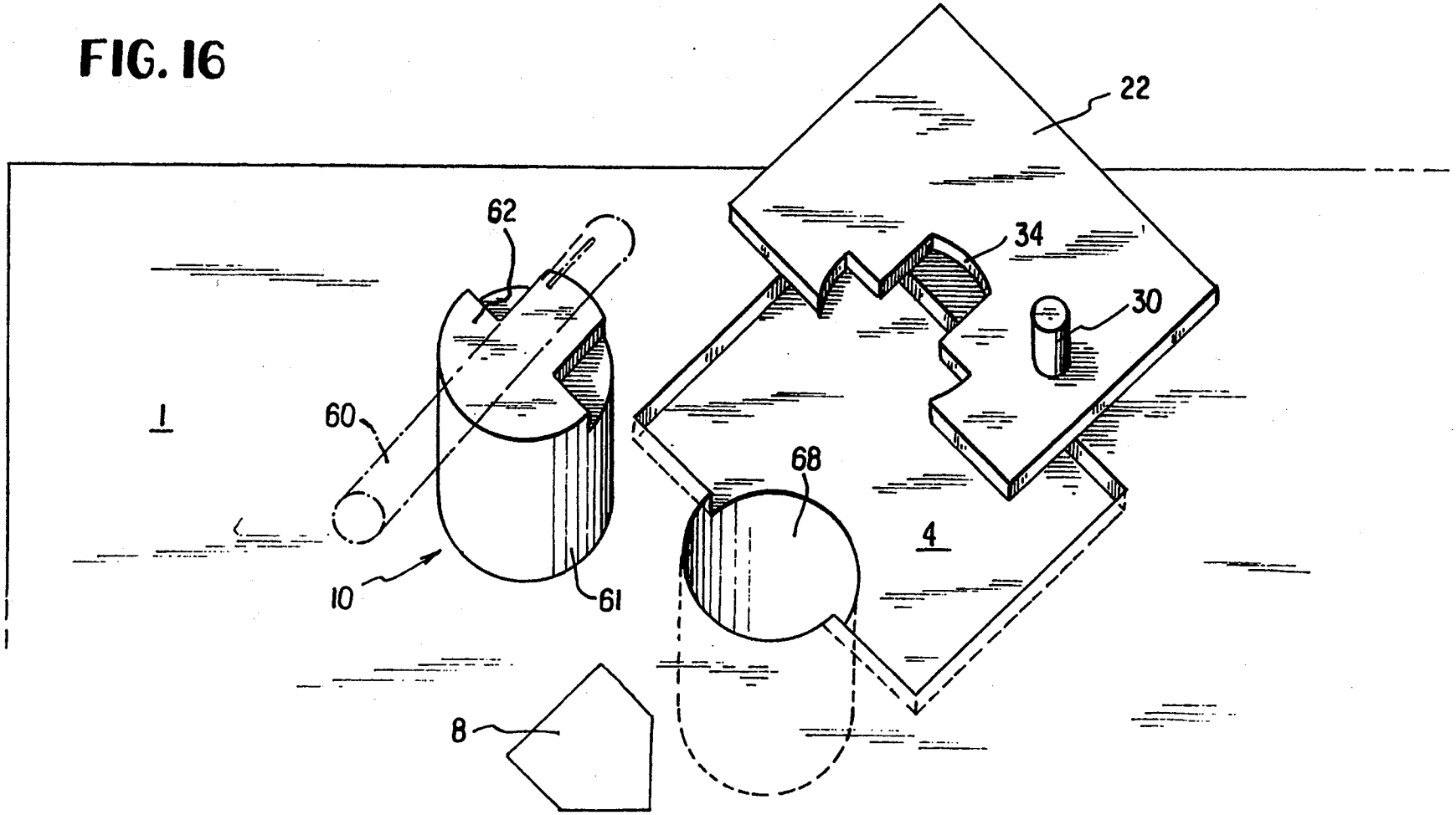
FIG. 16 is an exploded view illustrating the interface between the batter and the batting mechanism.

FIG. 16 is an exploded view illustrating the interface between the batter and the batting mechanism. The batting mechanism 10 slides into the cylindrical well 68. The batter 22 may then be positioned in the slot 4 in such a way that the groove 34 engages the key 62 which is located on the top of the batting mechanism. This allows the batting mechanism to interface snugly with both right-handed and left-handed batters, and further causes the batting mechanism to remain locked in place while the bat 60 is swung backwards.

FIG. 11 best illustrates the design of the preferred embodiment of the batting mechanism. The bat is horizontally disposed just above the key, and is supported by the link 63. The link is connected to the bat at one end and is connected at the other end to a spring 64 located on the bottom of the batting mechanism housing 61. The batting mechanism housing is provided with a hole 66 for the link. This hole is of sufficient diameter to allow the link to rotate freely.

The spring is held in place by one or more spring posts 65. The shape of the link is such that, as the bat is moved clockwise or counterclockwise relative to the batting mechanism housing 61, the bat causes the link to distort the spring, thus increasing the tension in the spring. While it is preferred that a metal spring is used to cause the bat to swing, the invention also contemplates the use of any other flexible material (i.e., a rubber band).

Figure 12:
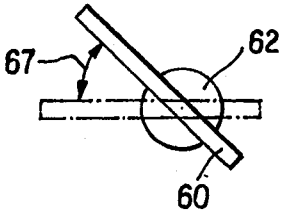
FIG. 12 is a top view of the batting mechanism illustrating the movement of the bat.

FIG. 12 illustrates the movement of the bat. The bat swings in a direction opposite to the direction in which it is displaced. The design of the link is such that the power with which the bat swings increases with the magnitude of the angle of displacement 67 between the resting position of the bat and the position of the bat after it has been displaced, so long as the magnitude of this angle of displacement does not exceed 180 degrees. The design of the batting mechanism allows the placement of the peg 30 on the batter 22 to control the power with which the bat is swung by controlling the magnitude of the angle of displacement 67.

Figure 13:
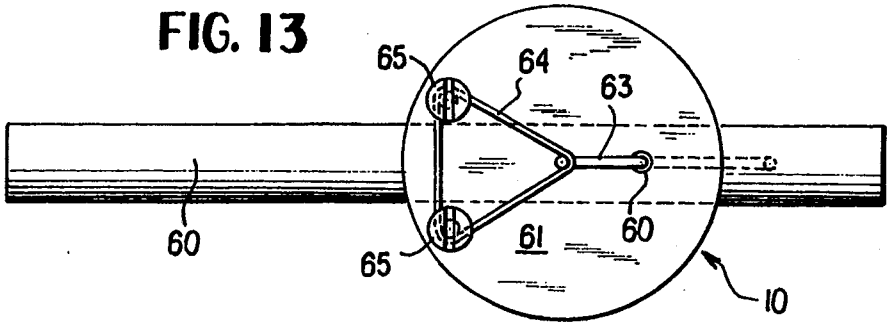
FIG. 13 is an enlarged bottom view of the batting mechanism.

FIG. 13 shows the bottom of the batting mechanism. In the particular embodiment shown, the spring 64 is wrapped around the link 63 and two spring posts 65. However, any suitable arrangement of posts which supports the spring with proper tension may be used. Furthermore, the invention contemplates the use of more than one spring.

Figure 14:
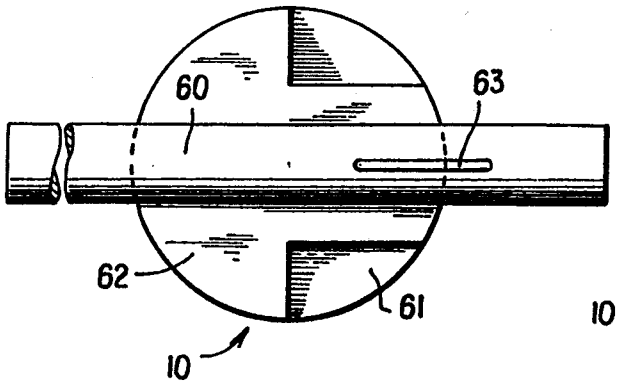
FIG. 14 is an enlarged top view of the batting mechanism.

FIG. 14 is an enlarged top view of the batting mechanism. In the preferred embodiment, the key 62 is mushroom shaped, and fits into an identically shaped cut-out 34 in the batter. However, any other appropriate means of interfacing the batting mechanism with the batter so as to arrest the movement of the batting mechanism housing 61 may be used.

The dimensions of the ball and bat are preferably such that the center of mass of the ball is above the striking point of the bat (i.e., a bat 2.75" in length and 0.25" in diameter, coupled with a ball ⅜" in diameter and having a weight of 0.06–0.07 oz.). Any combination of ball and bat dimensions which achieve this objective is suitable for the present invention.

The following illustrates some levels at which the game of the present invention may be played.

Level 1

Each player selects a starting lineup (9 playing pieces) out of the 18–25 playing pieces provided for each team, making sure that the starting lineup contains a batter capable of playing each defensive position. Each player then makes up his lineup. As the game progresses playing pieces may be substituted in the lineup for offensive or defensive purposes, in accordance with the rules of baseball.

The player who is in the field first arranges his players in such a way as to maximize the likelihood that they will be in the path of the batted ball. In doing so, the player "in the field" tries to anticipate the trajectory of the ball from the manner in which he intends to pitch the ball and from the known characteristics of the batter. The player in the field then attempts to pitch the ball in a direction and manner most likely to produce favorable results, taking into account the characteristics of the batter.

After the ball is pitched, the player "up at bat" attempts to hit the ball into the outfield, preferably without causing the ball to impinge on the defensive players. The game is scored in accordance with the rules of major league baseball. After the player in the field has accumulated three outs, the players switch roles, so that the player who was previously in the field is up at bat, and the player previously up at bat is in the field. The game continues in this way for nine innings, after which the player with the most scored runs is the victor. As in major league baseball, additional innings may be played if the game ends in a tie.

Although the game at this level avoids any involved use of chance-determining means, the players may, if they choose, become involved in certain events such as base stealing, advancing the runner on a caught fly ball, or sacrifice bunts, which may necessitate the use of such means to determine the outcome. In the interests of simplicity, these events are resolved in "yes-no" fashion based on the toss of a coin.

Level 2

The game is played as in Level 1, but is expanded to a certain degree by using a throw of dice (preferably two) to determine the outcome of a variety of plays such as base stealing, advancing the runner on a fly ball, or sacrifice bunts. The outcome of these events is influenced by a limited number of factors relating to the abilities of the players involved in the event. For example, if the batter is designated as Ab1, meaning that the batter has exceptional fielding ability, moderate throwing ability, and fast foot speed, and if the batter is on first base, the player up at bat might be required to roll 6–12 to successfully steal second base with the batter against a particular right-handed pitcher (a roll of 2–5 would be considered an out), or 8–12 to successfully steal second base against a left-handed pitcher of the same ability (a roll of 2–7 would be considered an out). The same results would be required for any other batter having the same footspeed (i.e., a batter designated as Bb1 or Ca1). However, a roll of 8–12 might be required for a batter with a footspeed designation of 2 to steal second base against the same right-handed pitcher, or 10–12 to steal second base against the same left-handed pitcher. Similarly, a roll of 10–12 and 11–12 might be required for a batter with a footspeed designation of 3 to steal second base against the same right-handed and left-handed pitcher, respectively.

Level 3

The game is played as in illustration 2, but is further expanded so that the probability of the outcome of a particular event is determined by the outcome of the throw of a pair of dice coupled with reference to statistical tables relating the statistical performance of the players involved in the event. The statistics might include, for example, such categories as base stealing attempts, the ratio of base stealing successes to attempts, and the ratio of successful sacrifice bunts to attempts.

What is claimed is:

1. A mechanical baseball game, comprising:

a playing board with a representation of a baseball field thereon, said board having specific positions corresponding to home plate, first base, second base, and third base;

a movable bat which hits from both sides of home plate;

a ball;

means for pitching said ball;

means for swinging said bat; and a plurality of batters, each comprising a flat card equipped with a protrusion which extends away from the plane of said card, wherein the placement of said protrusion on said card varies from batter to batter and determines the maximum backswing of said bat.

2. The game of claim 1, wherein the game is further provided with a plurality of fielders, each comprising a free standing flat surface with support means for supporting said surface on said playing board, wherein the width of said surface varies from fielder to fielder and determines the probability that the surface will come into contact with the ball during play.

3. The game of claim 2, wherein said width of said surface determines the fielding ability of said fielder.

4. The game of claim 1, wherein the game is further provided with a plurality of pitchers, each of which is modeled after a real life pitcher, and wherein each of said pitchers is equipped with means for simulating at least one of the pitching characteristics of the real life player that the pitcher is modeled after.

5. The game of claim 4, wherein at least some of said pitchers are equipped with means for simulating a left-handed pitcher, and at least some of said pitchers are equipped with means for simulating a right-handed pitcher.

6. The game of claim 1, wherein said batters are provided with positioning means for positioning said bat with respect to home plate to represent pull, straightaway, and punch hitting.

7. The game of claim 6, wherein said positioning means comprises an aperture in each of said batters for receiving said bat, and wherein said aperture controls the resting orientation of said bat relative to home plate.

8. The game of claim 1, wherein the game is further provided with means for controlling the direction in which the ball is pitched.

9. The game of claim 1, wherein said plurality of batters is divided into a first group of batters which hit from the left-hand side of home plate and a second group of batters which hit from the right-hand side of home plate.

10. The game of claim 1, wherein the placement of said protrusion on said card determines the hitting power of said batter.

11. In combination with a baseball game comprising a ball, a bat, and means for swinging said bat:

a plurality of batters, each of which comprises a flat card with a protrusion extending away from the plane of said card, wherein the placement of said protrusion on said card varies from batter to batter and determines the maximum backswing of said bat.

12. The combination of claim 11, wherein each of said batters further comprises a cut-out which locks onto said swinging means in such a way that said bat swings in a punch, pull, or straightaway manner.

13. The combination of claim 11, further comprising:

a rotatable pitching mechanism comprising a spring-loaded lever and a control rod, wherein said control rod rotates the pitching mechanism in such a way as to control the direction in which the ball is pitched.

14. The combination of claim 13 wherein said control rod causes the ball to be pitched by effecting the release of said spring-loaded lever.

15. A mechanical baseball game, comprising:

a playing board with a representation of a baseball field thereon, said board having specific positions corresponding to home plate, first base, second base, and third base;

a movable bat which hits from both sides of home plate;

a batting mechanism which controls said bat;

a ball;

means for pitching said ball;

means for swinging said bat;

a plurality of batters, each of said batters comprising a flat card equipped with a protrusion extending at approximately a right angle from the face of said card, wherein the placement of said protrusion on said card varies from batter to batter and determines the maximum backswing of said bat;

a first slot and a second slot situated on opposite sides of home plate for accommodating a batter, said slots being constructed so that at least some of said batters will fit into only one of said slots;

an aperture in each said card for receiving said batting mechanism, wherein the orientation of said aperture varies from batter to batter and controls the resting orientation of said bat relative to home plate; and a plurality of fielders, each comprising a free standing flat surface with support means for supporting said surface on said playing board, wherein the width of said surface varies from fielder to fielder and determines the probability that said surface will come into contact with said ball during play.

* * * * *